US009050615B2

(12) United States Patent
Schick et al.

(10) Patent No.: US 9,050,615 B2
(45) Date of Patent: Jun. 9, 2015

(54) APPARATUS AND METHOD FOR COATING SUBSTRATES FOR ANALYTE DETECTION BY MEANS OF AN AFFINITY ASSAY METHOD

(75) Inventors: Eginhard Schick, Rheinfelden (DE); Dominic Utinger, Ettingen (CH); Claudio Calonder, Basel (CH)

(73) Assignee: BAYER INTELLECTUAL PROPERTY GMBH, Monheim (DE)

( * ) Notice: Subject to any disclaimer, the term of this patent is extended or adjusted under 35 U.S.C. 154(b) by 1587 days.

(21) Appl. No.: 11/919,054

(22) PCT Filed: Apr. 22, 2006

(86) PCT No.: PCT/EP2006/003726

§ 371 (c)(1),
(2), (4) Date: Feb. 29, 2008

(87) PCT Pub. No.: WO2006/114249

PCT Pub. Date: Nov. 2, 2006

(65) Prior Publication Data

US 2009/0311773 A1 Dec. 17, 2009

(30) Foreign Application Priority Data

Apr. 26, 2005 (CH) ..... 735/05

(51) Int. Cl.
*B01L 3/00* (2006.01)
*B05B 17/06* (2006.01)

(52) U.S. Cl.
CPC ..... *B05B 17/0615* (2013.01); *B01L 3/00* (2013.01)

(58) Field of Classification Search
CPC ..... B01L 3/00; B05B 17/06115
USPC ..... 422/500–502
See application file for complete search history.

(56) References Cited

U.S. PATENT DOCUMENTS 3,514,847 A * 6/1970 Hotine ..... 427/74
5,432,099 A 7/1995 Ekins (Continued)

FOREIGN PATENT DOCUMENTS

EP 0 486 393 5/1992
EP 0 614 055 9/1994

(Continued)

OTHER PUBLICATIONS

Patent Abstracts of Japan, vol. 013, No. 336 (C-623), Jul. 27, 1989 & JP 01 115450 A (Seiko Epson Corp.), May 8, 1989.

(Continued)

*Primary Examiner* — Jyoti Nagpaul
(74) *Attorney, Agent, or Firm* — Wenderoth, Lind & Ponack, L.L.P.

(57) ABSTRACT

The invention relates to several embodiments of equipment for coating substrates for detecting one or more analytes by way of an affinity assay method, comprising: a receptacle receiving a liquid to be atomized ("liquid receptacle") with substances (compounds) to be deposited onto at least one surface of said substrates and an atomized volume produced by the liquid in the operating state; an actuator for triggering the atomization process and; a fixture for receiving and storing the substrates during the coating process. The invention is characterized in that the substrates are not in contact with the surface of the liquid to be atomized. The invention also relates to several embodiments of methods for coating substrates with coupler and/or passivation layers for use in the detection of one or more analytes by way of an affinity assay method.

26 Claims, 5 Drawing Sheets

(56) References Cited

U.S. PATENT DOCUMENTS

| | | | | |
|---|---|---|---|---|
| 5,445,934 | A | 8/1995 | Fodor et al. | |
| 5,807,755 | A | 9/1998 | Ekins | |
| 5,832,176 | A | 11/1998 | Jung | |
| 5,837,551 | A | 11/1998 | Ekins | |
| 5,881,714 | A | 3/1999 | Yokoi et al. | |
| 6,045,864 | A * | 4/2000 | Lyons et al. | 427/255.23 |
| 6,143,063 | A * | 11/2000 | Hayashi et al. | 106/287.18 |
| 6,365,418 | B1 | 4/2002 | Wagner et al. | |

FOREIGN PATENT DOCUMENTS

| | | |
|---|---|---|
| WO | 84/01031 | 3/1984 |
| WO | 95/33197 | 12/1995 |
| WO | 95/33198 | 12/1995 |
| WO | 96/35940 | 11/1996 |
| WO | 98/09156 | 3/1998 |
| WO | 00/65352 | 11/2000 |
| WO | 01/15800 | 3/2001 |
| WO | 01/55691 | 8/2001 |
| WO | 01/57254 | 8/2001 |
| WO | 01/79821 | 10/2001 |
| WO | 01/88511 | 11/2001 |
| WO | 02/21110 | 3/2002 |
| WO | 02/079765 | 10/2002 |
| WO | 03/050517 | 6/2003 |
| WO | 2004/023142 | 3/2004 |
| WO | 2004/099430 | 11/2004 |

OTHER PUBLICATIONS

Patent Abstracts of Japan, vol. 018, No. 437 (C-1238), Aug. 16, 1994 & JP 06 134367 A (Murata Mit Freundlichen Gruben Co., Ltd.), May 17, 1994.

Patent Abstracts of Japan, vol. 016, No. 133 (C-0925), Apr. 6, 1992 & JP 03 296460 A (Fujitsu General Ltd.), Dec. 27, 1991.

Abstract and English Translation of JP 06-134367.

Abstract and English Translation of JP 2005-046665.

Abstract and English Translation of JP 2008-508125.

English Translation of Excerpt of JP 01-115450.

English Translation of Excerpt of JP 03-296460.

English Translation of Excerpt of JP 61-046028.

* cited by examiner

APPARATUS AND METHOD FOR COATING SUBSTRATES FOR ANALYTE DETECTION BY MEANS OF AN AFFINITY ASSAY METHOD

This application is a U.S. nation stage of International Application No. PCT/EP2006/003726 filed Apr. 22, 2006.

BACKGROUND OF THE INVENTION

Numerous fields of application require determining a multiplicity of analytes in a sample of a possibly complex composition and nature, for example in diagnostic methods for determining the state of health of an individual or in pharmaceutical research and development for determining the influence of an organism and the complex mode of action thereof by supplying biologically active compounds.

While known analytical separation methods are usually optimized in order to fractionate a very large number of compounds present in a given sample according to a predefined physicochemical parameter such as, for example, the molecular weight or the quotient of molecular charge and mass, in as short a time as possible, bioaffinity assay methods are based on using in each case one biological or biochemical or synthetic recognition element of very high specificity, also referred to as "binding partner" or "specific binding partner" hereinbelow, in order to recognize and bind the corresponding (individual) analyte in a sample of a complex composition in a highly selective manner. Detection of a multiplicity of different compounds thus requires the use of a corresponding number of different specific recognition elements.

An assay method based on bioaffinity reactions may be carried out both in a homogeneous solution and on the surface of a solid support ("substrate"). Depending on the specific design of the method, the latter requires, after binding of the analytes to the corresponding recognition elements and, where appropriate, further detection substances and also, where appropriate, between various method steps, in each case washing steps in order to separate the produced complexes of said recognition elements and the analytes to be detected and also, where appropriate, further detection substances from the rest of the sample and the optionally employed additional reagents.

To determine a multiplicity of analytes or study a multiplicity of samples, methods comprising detection of different analytes in discrete sample receptacles or "wells" of "microtiter plates" are widespread, especially in industrial analytical laboratories. Most widespread here are plates with a grid of 8×12 wells over an area of typically approx. 8 cm×12 cm, with a volume of a few hundred microliters being required to fill a single well. However, it would be desirable in numerous applications to determine a plurality of analytes in a single sample receptacle at the same time, using as small a sample volume as possible. WO 84/01031, U.S. Pat. No. 5,807,755, U.S. Pat. No. 5,837,551 and U.S. Pat. No. 5,432,099 propose immobilization of analyte-specific recognition elements in the form of a small "spots" as discrete measurement areas, some of which are well below 1 $mm^2$, on a shared substrate in order to be able to determine the concentration of the analyte by binding only a small portion of analyte molecules present in a manner which depends only on the incubation time but which is, in the absence of a continuous flow, essentially independent of the absolute sample volume. A multiplicity of such "spots" as measurement areas in a two-dimensional arrangement on a shared substrate form a "microarray".

Methods for simultaneously detecting a multiplicity of different nucleic acids in a sample with the aid of corresponding complementary nucleic acids immobilized on a substrate in discrete, spatially separated measurement areas as recognition elements are now relatively widespread. For example, arrays of oligonucleotides as recognition elements, which are based on simple glass or microscope slides as substrates and which have a very high feature density (density of measurement areas on a shared solid support), have been disclosed. U.S. Pat. No. 5,445,934 (Affymax Technologies), for example, describes and claims arrays of oligonucleotides having a density of more than 1000 features per square centimeter.

Recently, descriptions of arrays and assay methods of a similar kind carried out therewith for simultaneously determining a multiplicity of proteins, for example in U.S. Pat. No. 6,365,418 B1, have become more frequent.

The simplest form of immobilizing the binding partners for analyte detection consists of physical adsorption, for example due to hydrophobic interactions between the binding partners and the substrate. However, the extent of these interactions can be modified greatly due to the composition of the medium and its physicochemical properties such as, for example, polarity and ionic strength. The adhesive capability of the binding partners after purely adsorptive immobilization on the surface is often insufficient, in particular if various reagents are added sequentially in a multi-step assay.

Preference is therefore often given to immobilizing the binding partners on an adhesion-promoting layer applied to the substrate. A multiplicity of materials are known as being suitable for preparing said adhesion-promoting layer, for example non-functionalized or functionalized silanes, epoxides, functionalized, charged or polar polymers and "self-assembled passive or functionalized mono- or polylayers", alkyl phosphates and alkyl phosphonates, multifunctional block copolymers such as, for example, poly(L)lysine/polyethylene glycols.

For example, WO 00/65352 describes coatings of bioanalytical sensor platforms or implants for medical applications as substrates with graft copolymers as adhesion-promoting layer, having a polyionic main chain (electrostatically) binding, for example, to a substrate and "non-interactive" (adsorption-resistant) side chains.

In order to minimize unspecific binding of analytes or their detection substances or other binding partners, in particular in the (uncovered) areas between the measurement areas (spots) for analyte detection, generated by way of locally addressed application, preference is frequently given to "passivating" these areas. For this purpose, compounds which are "chemically neutral", i.e. non-binding, with respect to the analytes or with respect to their detection substances or other binding partners are applied to the substrates between the spatially separated measurement areas.

Said components which are "chemically neutral" with respect to the analytes or their detection substances or other binding partners, i.e. which do not bind these (also referred to as "passivation compounds" hereinbelow), are known to be able to be selected from the groups consisting of albumins, in particular bovine serum albumin or human serum albumin, casein, unspecific, polyclonal or monoclonal, heterologous antibodies or antibodies empirically unspecific to the analyte(s) to be detected (in particular for immunoassays), detergents—such as, for example, Tween 20—, fragmented natural or synthetic DNA which does not hybridize with polynucleotides to be analysed, such as, for example, an extract of herring or salmon sperm (in particular for polynucleotide hybridization assays), or else uncharged but hydrophilic polymers such as, for example, polyethylene glycols or dextrans.

In order to be able to generate the likely quantifiable data from the binding signals, for example with the aid of fluorescence detection, of various measurement areas (spots) of a microarray, it is necessary to ensure a uniform surface density and binding activity of immobilized binding partners in measurement areas to be compared with one another. An essential precondition for meeting this requirement is high spatial homogeneity of the adhesion-promoting layer on which the discrete measurement areas (spots) are generated. Similar requirements also exist for the spatial homogeneity of the applied passivation layer to ensure a uniform, very low signal background between the designated measurement areas (spots).

Various methods can be employed for applying the adhesion-promoting layer to the substrate, depending on the molecular nature of the components of the adhesion-promoting layer to be generated and of course the thermal and chemical stability of the substrates to be coated. Silanizations may be carried out, for example, both in gas and liquid phases, for example with the aid of dipping methods. While the coating processes in the gas phase, in sufficiently large reaction vessels (compared to the size of the substrates to be coated), usually result in good homogeneity of the deposited layer, layers deposited from the liquid phase often have large spatial inhomogeneities, for example run tracks after application of dipping methods.

Since depositions from the gas phase usually require elevated process temperatures, the step of applying passivation layers usually takes place from the liquid phase, after applying the recognition elements for analyte detection which in most cases are not heat-resistant. The passivation step typically utilizes a dipping method. This involves dropping the substrate into a vessel filled with a solution of the compounds which are "chemically neutral" with respect to the analytes or their detection substances or other binding partners, i.e. which do not bind these ("passivating solution"), in order to wet the entire surface of the substrate as quickly as possible and simultaneously with the passivating solution. Subsequently, the substrate is left in the passivating solution ("incubated") for a defined period of time for enabling the compounds employed for surface passivation to be adsorbed to the substrate surface.

An advantage of this conventional method is the fact that it can be carried out without any further aids and does not require any special demands on the abilities of the laboratory personnel.

A disadvantageous property of this method, however, is a relatively high risk of "smudging" of spots at the moment when the substrate is immersed, by passivating solution flowing past the substrate surface. In the process, material desorbs from the discrete measurement areas (immobilized specific binding partners) and is washed away and can be adsorbed again in the surrounding area in the direction of the relative direction of flow of the passivating solution (based on the substrate surface) in areas which are not yet completely covered with passivating compounds.

The extent of "smudging" of spots depends inter alia on the surface density of the immobilized specific binding partners in the discrete measurement areas and on the composition of the passivating solution, in particular on the solubility of the specific binding partners in said passivating solution. In the case of a high feature density, i.e. in the case of a short distance between neighboring spots, the "smudging" effect may greatly impair or even rule out quantitative analysis of the assay signals from an array of measurement areas, due to the resulting inhomogeneous distribution of background signals from the areas between said discrete measurement areas. This unwanted effect may result in a meaningful analysis of the assay signals being no longer possible, in particular if immobilized material is transported even from one spot to a neighboring spot. Another disadvantage of this method is the inherent need for relatively large volumes of passivating solution and relatively high costs associated therewith.

The described "smudging" effect is known to be prevented by the use of spraying methods, for example with the aid of atomizers. This involves applying the passivating solution in the form of small liquid droplets to the substrate surface until a continuous liquid film has formed on said surface. The substrate surface is then incubated in a saturated atmosphere of the liquid vapor (i.e. at 100% atmospheric humidity in the case of an aqueous passivating solution) within a predefined period of time, again in order to thereby enable the compounds employed for surface passivation to be adsorbed to the substrate surface. Run tracks are avoided by storing the substrates horizontally (with respect to the substrate surface to be coated) during said passivation process.

The spots can substantially be prevented from "smudging" by carrying out this process correctly. Another advantage is the amount of passivating solution needed, which is typically reduced by a factor of 10 compared to the dipping method described above.

However, a difficulty inherent to the method is the required uniform wetting and quite accurate metering of the amount of liquid applied, which are required for producing a homogeneous liquid film on the substrate surface, thereby putting increased demands on the operators. For example, "smudging" of the spots can again occur in the event of passivating solution being applied in excess. The international patent application WO 01/57254, for example, describes a modular system based on this coating method for producing microarrays with nucleic acids, proteins or other chemical or biological compounds as specific binding partners immobilized in discrete measurement areas.

Despite clear advantages in comparison with the dipping method, the results of the spraying method are likewise not optimal. Due to the fact that the droplets are expelled via a nozzle or an atomizer, said droplets possess a more or less strong momentum directed toward the surface to be coated at the moment when they hit said surface. This is associated with the risk of said droplets spattering when hitting the surface to give even smaller droplets, so that the edges of the measurement areas (spots) to be generated are usually not generated in a well-defined manner. Moreover, spraying methods usually generate relatively large droplets with a large variation in droplet size.

Object of the Invention

There is therefore the need for developing a coating method from the liquid phase and for an apparatus for carrying out said coating method, which can achieve a similarly high homogeneity of the generated layers as for deposition from the gas phase and which requires the use of a very small amount of liquid. It is moreover desirable for a corresponding novel coating method and a coating apparatus to be used therefor to be suitable both for applying an adhesion-promoting layer and a passivating layer. Under the aspect of economic viability, the solution should be as cost-effective as possible, i.e. the complexity of the equipment should be as low as possible. A corresponding novel coating apparatus should be easy to operate and a coating method to be carried out therewith should be easy to automate.

SUMMARY OF THE INVENTION

Surprisingly, we have now found that said requirements can be met by the method according to the invention, which is described below and which is based on atomization of solution which contains the compounds to be applied to the substrates, and which does not require any substantial impulse of droplets to be deposited from the mist on the substrates in the direction of said substrates. The coating apparatus according to the invention, which has been developed in order to carry out said method, is characterized by a very simple construction which can make use of inexpensive commercially available components, and also by ease of operation.

The method of the invention, to be carried out using a coating apparatus of the invention according to one of the embodiments described below, is suitable for applying both adhesion-promoting and passivating layers to any, but preferably planar, substrates for detecting analytes in affinity assay methods.

The method of the invention is a development of the above-described atomization method, with very fine liquid droplets being generated for the method of the invention in a preferred embodiment by ultrasound treatment. The coating apparatus employed for said method comprises, in a preferred embodiment, a closed receptacle having a support for horizontal storage of the substrates (with respect to the surface of the liquid to be atomized) and an ultrasound generator located beneath it, which is immersed in the liquid to be atomized. The method of the invention is characterized in that the droplets generated are substantially smaller than in the case of the spraying method. In operation, a very dense mist is generated above the liquid to be atomized, which mist in a preferred embodiment is evenly distributed in the receptacle by causing a turbulent flow with the aid of a weak, additionally employed nitrogen stream, wherein the receptacle is preferably closed apart from gas inlets and gas outlets. Since there is no flow of the coating solution with respect to the surfaces of the substrates to be coated, "smudging" of the spots, as it has been described for the dipping method, is prevented in the method of the invention. Consequently, there are also hardly any restrictions due to the method with regard to selecting the composition both of a passivating solution and of a "spotting solution" to be used in a preceding step for immobilizing the specific binding partners in discrete measurement areas, as well as the concentration of this solution to specific binding partners and thereby of the resulting surface density of immobilized specific binding partners in said measurement areas. Due to the absence of flows along the surface of the substrates during the surface passivation step, there is in particular no risk whatsoever of "smudging" between neighboring spots, and, as a result, their density which can be generated in an array of measurement areas is restricted only by the accuracy of metering and of positioning of the apparatus to be used for generating the discrete measurement areas ("spotter"). The method of the invention is moreover characterized by the possibility of simultaneously coating a large number of substrates in a shared, appropriately sized receptacle and ease of automation and can also be readily carried out by untrained personnel. The liquid volumes required and to be used for coating the substrates are of a similar order of magnitude as in the case of the spraying method.

DETAILED DESCRIPTION OF THE INVENTION

Figure 1:
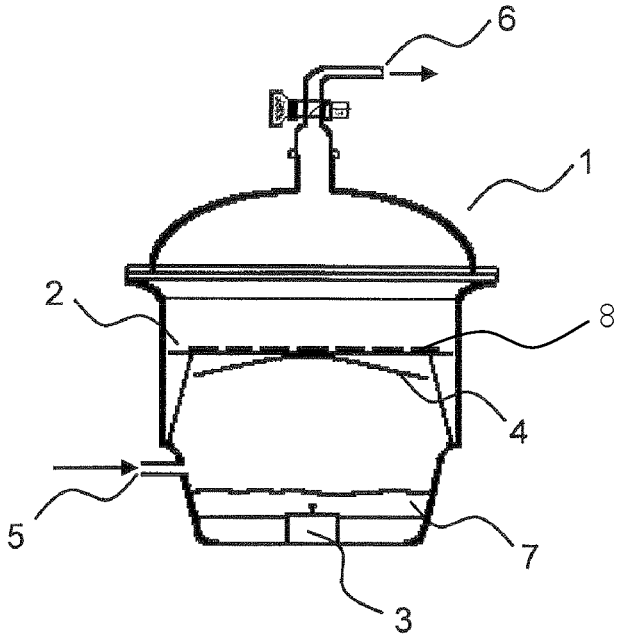
FIG. 1 depicts diagrammatically a coating apparatus of the invention.

The present invention firstly relates to apparatus for coating substrates for detecting one or more analytes by way of an affinity assay method, comprising:

- a receptacle for receiving a liquid to be atomized ("liquid receptacle") containing substances (compounds) to be deposited on at least one surface of said substrates and a mist volume generated above the liquid during operation,
- an actuator for inducing the atomization process and
- a support for receiving and storing the substrates during the coating process, characterized in that the substrates are not in contact with the surface of the liquid to be atomized.

The term "liquid to be atomized" here means the total amount of liquid inside the coating apparatus of the invention, on which the impulses of the actuator for liquid atomization act, with the result of conversion of part of said liquid to mist. Preference is given to generating the mist above the liquid to be atomized by the action of ultrasound within said liquid. Correspondingly, preference is given to said actuator serving to generate ultrasound.

Various industrial processes for generating ultrasound are known, for example with the aid of piezoelectric crystals, oscillating membranes etc. Preference is given to said actuator comprising the membrane of an ultrasound generator.

Preference is moreover given to said actuator being immersed in liquid to be atomized during operation. Preferably, said actuator is completely inside the liquid to be atomized.

It is furthermore advantageous if the intensity and frequency of the ultrasound acting on the liquid to be atomized can be regulated and/or measured by means of suitable means.

As mentioned in the demands on a novel coating method, the uniformity and high homogeneity of the layer to be generated are of the utmost importance. In order to be able to ensure this, a size distribution as narrow as possible of very small droplets of a mist to be deposited is desirable. In the case of simple, commercial atomizers as applied especially in terraristics, however, the appearance of large droplets or even of splashes from the liquid to be atomized must also be reckoned with.

Preference is therefore given to the coating apparatus of the invention comprising a droplet precipitator. Said droplet precipitator is to be arranged in the spatial volume between the surface of the liquid to be atomized and the support on which the substrates to be coated are stored during the coating process.

Different embodiments of droplet precipitators are suitable. In principle, a droplet precipitator to be used can be impermeable to vapor and mist (if said droplet precipitator is, for example, a closed solid body). It may be advantageous if the droplet precipitator has the geometric shape of a concave mirror. An example of a droplet precipitator which may be used is a vaulted glass bowl (having a concave surface).

A droplet precipitator to be used may also be permeable to droplets up to a defined size, for example having a diameter of less than 200 μm. This may be implemented technically by said droplet precipitator comprising a fine-mesh netting whose mesh size determines the maximum size of droplets to be let through.

Preference is given to the substrates, when stored in the support, being coated on their side/surface which faces away from the surface of the liquid to be atomized during the coating process, with coating on other surfaces not necessarily being ruled out.

Using masks to be applied to the substrates to be coated, it is also possible to generate geometrically structured coatings by, where appropriate, sequential atomization of one or more optionally different liquids by using coating apparatus of the invention in a coating method of the invention. A precondition for generating coated areas on the substrates, whose geometry can be reproduced, here is to cover in a fluidically sealing way in each case areas of the substrate which are not to be coated by a corresponding suitable mask, so that mist droplets cannot reach the areas that are not to be coated.

In order to meet the primary aim of generating a very uniform and homogeneous coating of the substrates, it is furthermore advantageous if the coating apparatus of the invention additionally comprises means for generating a uniform distribution of the mist generated and to be deposited on the substrates in the surroundings of said substrates.

For this, it may be helpful, for example, if a gas is passed into the receptacle of the apparatus (i.e. into the air space or gas space or mist space), which gas mixes and/or forms a turbulent flow with the mist generated.

It is therefore advantageous if the coating apparatus additionally comprises at least one gas inlet. The apparatus may additionally comprise also one or more outlets for discharging gas and/or mist.

It may moreover be advantageous if said means for generating a uniform distribution of the mist generated and to be deposited on the substrates in the surroundings of said substrates comprise a ventilator, which is used to produce a turbulent flow of the generated mist and, where appropriate, gases additionally passed into the receptacle of the apparatus, in order to achieve better mixing and thereby to eliminate mist distribution inhomogeneities.

To ensure constant and well-defined conditions during the coating process, it may be furthermore advantageous if the coating apparatus of the invention additionally comprises means for controlling and/or regulating the temperature of the liquid to be atomized and/or of individual or all walls of the liquid receptacle. Preference is also given to the support of the coating apparatus for receiving and/or storing the substrates during the coating process can be thermostated.

For the same reason it may also be advantageous if the coating apparatus additionally comprises means for controlling and/or regulating the pressure inside the liquid receptacle during the coating process.

To ensure the uniformity and homogeneity of the coating of the substrates, in particular to eliminate any influence of inhomogeneities of the mist to be generated in the receptacle of the apparatus of the invention, which inhomogeneities may still be present despite appropriate precautionary measures, it may moreover be advantageous if the coating apparatus additionally comprises means for rotating the substrates on an axis perpendicular to the plane of the support.

Owing to an inherent property of the method of the invention, namely an essentially spatially undirected deposition, droplet formation, and thereby application of the compounds for surface coating present, takes place not only on the free surfaces of the substrates but, for example, also on the walls of the liquid receptacle of the coating apparatus of the invention. Since the compounds to be applied to the substrates can be very special substances in a highly pure form, which consequently may be relatively expensive, preference is given to the coating apparatus of the invention additionally comprising means for collecting and recycling/recovering atomized liquid deposited on the walls of the liquid receptacle.

It is moreover advantageous if the coating apparatus of the invention additionally comprises means for facilitating cleaning of the liquid receptacle. For example, said means may comprise a hydrophobic coating of the surface of said receptacle walls, both for recycling liquid to be recycled along the inner walls of the liquid receptacle and into the liquid to be atomized and for facilitating cleaning. Such means may also relate to the geometric shape, for example by avoiding or at least rounding off corners in which liquid can accumulate and is very difficult to remove from.

Preference is given to storing the substrates to be coated essentially horizontally in the support of the coating apparatus. The term "essentially horizontally" is intended here to include deviations of up to +/−10° from horizontal storage.

It is moreover advantageous if the coating apparatus additionally comprises means for controlled adjustment and/or variation of the distance between the surface of the liquid to be atomized and surfaces of the substrates to be coated.

The liquid receptacle is preferably closed, apart from optional inlets for gas and optional additional outlets for gas and/or mist.

The liquids to be atomized are preferably low viscosity liquids having a viscosity of less than 3 cP. They may in particular be aqueous solutions. However, the liquids to be atomized may also be organic, in particular alcoholic solutions.

Moreover, preference is given to the substrates to be coated being essentially planar. The term "essentially planar" here means that said substrates comprise a plane which contains the surface to be coated, apart from a possibly present three-dimensional structure (such as, for example, side walls of sample receptacles to be provided on the substrate surface), and a second plane essentially parallel thereto which contains the opposite surface of the substrates, wherein the term "essentially parallel" includes deviations of up to +/−10° of parallelity. "Essentially planar" means substrates having both smooth and rough surfaces to be coated.

The substrates to be coated may consist of a single (self-supporting) layer, such as, for example, glass slides, or else of multiple layers.

Preference is given to at least one layer of the substrates to be coated being essentially optically transparent in the direction of propagation of an incident excitation light or measurement light.

"Optical transparency" of a material or of a substrate here means that the travel path length of a light propagating in said material or in said substrate or of a light guided in the (high-refractive index) wave-guiding film of a substrate designed as optical waveguide (see below) in at least a subsection of the visible spectrum (between 400 nm and 750 nm) is greater than 2 mm, if said travel length path is not limited by structures for changing the direction of propagation of said light. For example, the travel path length of optically visible light, i.e. the distance on the path of said light in the corresponding material, until the light intensity is reduced to a value of 1/e of the original intensity when said light entered said material, may be in the order of magnitude of from several centimeters (e.g. in thin-film waveguides, see below) up to meters or kilometers (in the case of light guides for optical signal transmission). In the case of a grating-waveguide structure based on a thin-film waveguide, the length of the propagation vector of a light guided within the wave-guiding layer may be restricted to a few micrometers by an outcoupling diffractive grating (designed in the wave-guiding layer). However, this restriction of the travel path length is then due to structuring rather than the material properties of the structure. In accordance with the present invention, such a grating-waveguide structure is to be referred to as "optically transparent". Within the scope of the present invention, "essentially optically transparent" should also refer to those substrates or layers that attenuate the intensity of a light transilluminating said substrates or layers by less than 50%.

The at least one layer of substrates to be coated, which is essentially optically transparent in the direction of propagation of an incident excitation light or measurement light, may comprise, for example, a material selected from the group comprising silicates, e.g. glass or quartz, transparent thermoplastic moldable, injection-moldable or millable plastics, for example polycarbonates, polyimides, acrylates, in particular polymethyl methacrylates, polystyrenes, cyclo-olefin polymers and cyclo-olefin copolymers.

In a special embodiment of a coating apparatus of the invention, the substrates to be coated comprise a thin metal layer, preferably made of gold or silver, where appropriate on an intermediate layer below, having a refractive index of preferably <1.5, wherein the thickness of said metal layer and of the possible intermediate layer has been selected so as for a surface plasmon to be able to be excited at a wavelength of an incident excitation light and/or at the wavelength of a luminescence generated. The thickness of said metal layer is preferably between 10 nm and 1000 nm, particularly preferably between 30 nm and 200 nm.

The conditions for generating a surface plasmon resonance as well as for combination with luminescence measurements and also with wave-guiding structures have been described in the literature many times.

The term "luminescence" in the present application refers to the spontaneous emission of photons in the ultraviolet to infrared range after optical or nonoptical, for example electrical or chemical or biochemical or thermal, excitation. The term "luminescence" includes, for example, chemiluminescence, bioluminescence, electroluminescence and in particular fluorescence and phosphorescence. Fluorescence and phosphorescence are particularly preferred forms of luminescence.

Preference is given to the substrates to be coated comprising optical waveguides comprising one or more layers. Said substrates may be designed throughout as optical waveguides or may comprise discrete wave-guiding regions.

"Continuous wave-guiding regions" mean correspondingly wave-guiding regions which extend essentially across the entire region of the portion of the substrate surface utilized for analyte detection, without interruption of the high-refractive index, wave-guiding layer.

Optical waveguides are particularly suitable as substrate for analyte detection in an affinity assay method because said waveguiding is associated with the formation of an "evanescent" field at the boundaries of the high-refractive index wave-guiding layer to the neighboring layers (which may also mean air) with a lower refractive index. The depth of penetration of said evanescent field into the surroundings is limited to dimensions of less than the wavelength of the guided light (e.g. to from 200 nm to 400 nm), so that interactions of analyte molecules or of detection molecules or detection molecule moieties (such as, for example, fluorescent labels) can be excited and observed by this evanescent field in a spatially highly selective manner on a surface of the waveguide, and interfering signals from the far field, for example from the depth of a sample medium, can largely be eliminated.

Therefore preference is usually given to the continuous or discrete wave-guiding regions of substrates to be coated comprising a surface to be coated of said substrates.

Particular preference is given to the substrates to be coated comprising planar optical thin-film waveguides having an essentially optically transparent, wave-guiding layer (a) upon a second, likewise essentially optically transparent layer (b) having a lower refractive index than layer (a) and, where appropriate, a likewise essentially optically transparent intermediate layer (b') between layer (a) and layer (b) having likewise a lower refractive index than layer (a).

With a given material of layer (a) and a given refractive index, the sensitivity increases with decreasing layer thickness down to a lower limit of said layer thickness. Said lower limit is determined by light conduction stopping when falling below a value dependent on the wavelength of the light to be guided and by an observed increase in propagation losses with further reduction in layer thickness in very thin layers. Preference is given to the product of thickness of layer (a) and its refractive index being from one to ten tenths, preferably one to two thirds, of the wavelength of an excitation light or measurement light to be coupled into layer (a).

A multiplicity of methods for coupling excitation light or measurement light into an optical waveguide are known. In the case of a relatively thick wave-guiding layer up to a self-supporting waveguide, it is possible to focus the light onto an end face of said waveguide in such a way that said light is guided via total internal reflection, by using lenses of a suitable numerical aperture. In the case of waveguides having a greater transverse width than the waveguide layer thickness, preference is given to using cylindrical lenses for this. Said lenses may be both arranged spatially distant from the waveguide and directly linked therewith. In the case of lower waveguide layer thicknesses, this form of end face coupling is less suitable. In this case it is better to use coupling via prisms which are attached to the waveguide preferably without gaps or which are connected with the waveguide through a refractive index-adjusting liquid. It is also possible to supply the excitation light via an optical fiber to the optical waveguide and to couple in said excitation light via an end face or to couple over the light coupled in in a different waveguide into the waveguide by bringing both waveguides so close to one another that their evanescent fields overlap, thereby enabling energy to be transferred.

Preference is therefore given to the discrete or continuous wave-guiding regions of the substrates to be coated being made to optically interact with one or more optical coupling elements for coupling in excitation light or measurement light of one or more light sources during the detection step of an affinity assay method using said substrates, wherein said optical coupling elements are selected from the group comprising prism couplers, evanescent couplers with optical waveguides brought into contact with each other and having overlapping evanescent fields, end face couplers with focusing lenses, preferably cylindrical lenses, arranged in front of an end side of a wave-guiding layer of the substrates, and grating couplers.

Particular preference is given to the discrete or continuous wave-guiding regions of the substrates to be coated being in contact with one or more grating structures (c) which enable excitation light or measurement light to be coupled into wave-guiding layers of said substrates, and/or with one or more grating structures (c') which enable excitation light or measurement light to be coupled out of wave-guiding layers of said substrates, wherein grating structures (c) and (c') that are present on a substrate at the same time may have identical or different grating periods.

Said grating structures are preferably relief gratings with any profile, for example with a rectangular, triangular, saw-tooth, semicircular or sinusoidal profile, or phase gratings or volume gratings with a periodic modulation of the refractive index in the essentially planar layer (a). Grating structures (c) are preferably designed as surface relief gratings.

The grating structures (c) and/or (c') may be mono- or multidiffractive and may have a depth of 2 nm-100 nm, preferably 10 nm-30 nm, and a period of 200 nm-1000 nm, preferably 300 nm-700 nm. The ratio of the slat width of the rulings of the gratings to the grating period may be between 0.01 and 0.99, with a ratio of between 0.2 and 0.8 being preferred.

Preference is given to the refractive index of the first optically transparent layer (a) being greater than 1.8. Preference is also given to the first optically transparent layer (a) comprising a material from the group comprising silicon nitride, $TiO_2$, ZnO, $Nb_2O_5$, $Ta_2O_5$, $HfO_2$, and $ZrO_2$, particularly preferably $TiO_2$, $Ta_2O_5$ or $Nb_2O_5$.

Preference is moreover given to the second optically transparent layer (b) of the substrates to be coated comprising a material of the group comprising silicates, for example glass or quartz, transparent thermoplastic moldable, injection-moldable or millable plastics, for example polycarbonates, polyimides, acrylates, in particular polymethyl methacrylates, polystyrenes, cyclo-olefin polymers and cyclo-olefin copolymers.

Various embodiments of planar optical thin-film waveguides, that are suitable as substrates, are described, for example, in the international patent applications WO 95/33197, WO 95/33198, WO 96/35940, WO 98/09156, WO 01/79821, WO 01/88511, WO 01/55691 and WO 02/79765. The embodiments of special substrates described in said patent applications and usually referred to as sensor platforms there, and methods to be carried out therewith for analyte detection and also the content of these application documents are hereby incorporated in their entirety as part of the present invention.

A preferred group of embodiments of coating apparatus of the invention is characterized in that the substrates to be coated enable one or more analytes to be detected by way of an affinity assay method by means of detection of one or more excited luminescence events.

Another group of embodiments is characterized in that the substrates to be coated enable one or more analytes to be detected by way of an affinity assay method by means of detection of changes of the effective refractive index in the near field (evanescent field) on a surface of said substrates.

The present invention further relates to a method of coating substrates for detecting one or more analytes by way of an affinity assay method, characterized in that

- said substrates to be coated are placed in a support of a coating apparatus of the invention according to any of the described embodiments,
- liquid present in the liquid receptacle of said coating apparatus is atomized and
- substances (compounds) present in the atomized liquid are deposited from the mist generated onto the substrates to be coated, wherein the substrates are not in contact with the surface of the liquid to be atomized.

Preference is given to generating the mist above the liquid to be atomized by the action of ultrasound within said liquid. Correspondingly, preference is given to said actuator serving to generate ultrasound.

Various industrial processes for generating ultrasound are known, for example with the aid of piezoelectric crystals, oscillating membranes etc. Preference is given to said actuator comprising the membrane of an ultrasound generator and liquid being atomized by means of ultrasound waves generated therein.

Preference is moreover given to said actuator being immersed in liquid to be atomized during operation. Preferably, said actuator is completely inside the liquid to be atomized.

It is furthermore advantageous if the intensity and frequency of the ultrasound acting on the liquid to be atomized can be regulated and/or measured by means of suitable means.

Preference is moreover given to the coating apparatus comprising a droplet precipitator which prevents splashes and large droplets of the liquid to be atomized from coming into contact with the substrates to be coated. A "large" droplet means a droplet having a diameter of more than 200 μm. The droplet precipitator may be impermeable to gas and mist. For example, the droplet precipitator may be a closed solid body. It may be advantageous if the droplet precipitator has the geometric shape of a concave mirror. An example of a droplet precipitator which may be used is a vaulted glass bowl (having a concave surface).

A droplet precipitator to be used may also be permeable to droplets up to a defined size. This may for example be implemented technically by said droplet precipitator comprising a fine-mesh netting whose mesh size defines the maximum size of droplets to be let through.

In order to meet the primary aim of generating a very uniform and homogeneous coating of the substrates, it is furthermore advantageous if the coating apparatus of the invention additionally comprises means for generating a uniform distribution of the mist generated and to be deposited on the substrates in the surroundings of said substrates.

For this, it may be helpful, for example, if the coating apparatus additionally comprises at least one gas inlet via which a gas is passed into the liquid receptacle, which gas mixes with the mist generated. The apparatus may additionally also comprise one or more outlets for discharging gas and/or mist.

It may also be advantageous for the uniformity and homogeneity of the coating if a uniform distribution of the mist generated and to be deposited on the substrates is generated in the surroundings of said substrates with the aid of a ventilator.

To ensure constant and well-defined conditions during the coating process it may be furthermore advantageous if the coating apparatus of the invention additionally comprises means for controlling and/or regulating the temperature of the liquid to be atomized and/or of individual or all walls of the liquid receptacle and the temperature of the liquid to be atomized and/or of individual or all walls of the liquid receptacle is controlled and/or varied during the coating process. Preference is also given to the support of the coating apparatus for receiving and/or storing the substrates being thermostated during the coating process.

For the same reason it may also be advantageous if the coating apparatus additionally comprises means for controlling and/or regulating the pressure inside the liquid receptacle during the coating process and the pressure is controlled and/or varied during the coating process.

To ensure the uniformity and homogeneity of the coating of the substrates, in particular to eliminate any influence of inhomogeneities of the mist to be generated in the receptacle of the apparatus of the invention, which inhomogeneities may still be present despite appropriate precautionary measures, it may moreover be advantageous if the substrates are rotated on an axis perpendicular to the plane of the support during the coating process.

Preference is given to coating the substrates on their side/surface which faces away from the surface of the liquid to be atomized, when stored in the support during the coating process, wherein a coating on other surfaces is not necessarily ruled out.

A particular variant of the method of the invention is characterized in that geometrically structured coatings are generated by optionally sequential atomization of one or more optionally different liquids by using a coating apparatus of the invention in a coating method of the invention and by using masks to be applied to the substrates to be coated. A precondition for generating coated areas on the substrates, whose geometry can be reproduced, here is to cover in a fluidically sealing way in each case areas of the substrate which are not to be coated by a corresponding suitable mask, so that mist droplets cannot reach the areas that are not to be coated.

Preference is given to storing the substrates to be coated essentially horizontally in the support of the coating apparatus during the coating process.

It is moreover advantageous if the coating apparatus additionally comprises means for controlled adjustment and/or variation of the distance between the surface of the liquid to be atomized and surfaces of the substrates to be coated, thereby setting a well-defined distance between said liquid and the liquid surfaces to be coated over the period of the coating process.

To reduce the consumption of liquid to be atomized, preference is also given to collecting liquid deposited on the walls of the liquid receptacle and recycling said liquid back to the liquid to be atomized.

The liquid receptacle of the coating apparatus is preferably closed, apart from optional inlets for gas and optional additional outlets for gas and/or mist.

The liquids to be atomized are preferably low viscosity liquids having a viscosity of less than 3 cP. They may in particular be aqueous solutions. However, the liquids to be atomized may also be organic, in particular alcoholic solutions.

Moreover, preference is given to the substrates to be coated being essentially planar.

The substrates to be coated may consist of a single (self-supporting) layer, such as, for example, glass slides, or else of multiple layers.

Preference is given to at least one layer of the substrates to be coated being essentially optically transparent in the direction of propagation of an incident excitation light or measurement light.

The at least one layer of substrates to be coated, which is essentially optically transparent in the direction of propagation of an incident excitation light or measurement light, may comprise, for example, a material selected from the group comprising silicates, e.g. glass or quartz, transparent thermoplastic moldable, injection-moldable or millable plastics, for example polycarbonates, polyimides, acrylates, in particular polymethyl methacrylates, polystyrenes, cyclo-olefin polymers and cyclo-olefin copolymers.

In a special embodiment of a coating apparatus of the invention, the substrates to be coated comprise a thin metal layer, preferably made of gold or silver, where appropriate on an intermediate layer below, having a refractive index of preferably <1.5, wherein the thickness of said metal layer and of the possible intermediate layer has been selected so as for a surface plasmon to be able to be excited at a wavelength of an incident excitation light and/or at the wavelength of a luminescence generated.

Preference is given to the substrates to be coated comprising optical waveguides comprising one or more layers. Said substrates may be designed throughout as optical waveguides or may comprise discrete wave-guiding regions.

Preference is usually given here to the continuous or discrete wave-guiding regions of substrates to be coated comprising a surface to be coated of said substrates.

Particular preference is given to the substrates to be coated comprising planar optical thin-film waveguides having an essentially optically transparent, wave-guiding layer (a) upon a second, likewise essentially optically transparent layer (b) having a lower refractive index than layer (a) and, where appropriate, a likewise essentially optically transparent intermediate layer (b') between layer (a) and layer (b) having likewise a lower refractive index than layer (a).

Preference is given here to the discrete or continuous wave-guiding regions of the substrates to be coated being made to optically interact with one or more optical coupling elements for coupling in excitation light or measurement light of one or more light sources during the detection step of an affinity assay method using said substrates, wherein said optical coupling elements are selected from the group comprising prism couplers, evanescent couplers with optical waveguides brought into contact with each other and having overlapping evanescent fields, end face couplers with focusing lenses, preferably cylindrical lenses, arranged in front of an end side of a wave-guiding layer of the substrates, and grating couplers.

Particular preference is given to the discrete or continuous wave-guiding regions of the substrates to be coated being in contact with one or more grating structures (c) which enable excitation light or measurement light to be coupled into wave-guiding layers of said substrates, and/or with one or more grating structures (c') which enable excitation light or measurement light to be coupled out of wave-guiding layers of said substrates, wherein grating structures (c) and (c') that are present on a substrate at the same time may have identical or different grating periods.

Preference is given to the refractive index of the first optically transparent layer (a) being greater than 1.8. Preference is also given to the first optically transparent layer (a) comprising a material from the group comprising silicon nitride, $TiO_2$, ZnO, $Nb_2O_5$, $Ta_2O_{55}$ $HfO_2$, and $ZrO_2$, particularly preferably $TiO_2$, $Ta_2O_5$ or $Nb_2O_5$.

Preference is moreover given to the second optically transparent layer (b) of the substrates to be coated comprising a material of the group comprising silicates, for example glass or quartz, transparent thermoplastic moldable, injection-moldable or millable plastics, for example polycarbonates, polyimides, acrylates, in particular polymethyl methacrylates, polystyrenes, cyclo-olefin polymers and cyclo-olefin copolymers.

A preferred group of embodiments of the coating method of the invention is characterized in that the substrates to be coated enable one or more analytes to be detected in an affinity assay method by means of detection of one or more excited luminescence events.

Another group of embodiments is characterized in that the substrates to be coated enable one or more analytes to be detected in an affinity assay method by means of detection of changes of the effective refractive index in the near field (evanescent field) on a surface of said substrates.

One group of embodiments of the method of the invention is characterized in that the layer to be deposited on the substrates is an adhesion-promoting layer.

Preference is given here to said adhesion-promoting layer having a thickness of less than 200 nm, particularly preferably of less than 20 nm.

A multiplicity of compounds are suitable for preparing the adhesion-promoting layer in a coating process of the invention. For example, said adhesion-promoting layer may comprise a chemical compound from the groups comprising silanes, functionalized silanes, epoxides, functionalized, charged or polar polymers and "self-organized passive or functionalized mono- or multilayers", thiols, alkyl phosphates and alkyl phosphonates, multifunctional block copolymers such as, for example, poly(L)lysine/polyethylene glycols.

The method of the invention is characterized in that one or more specific binding partners are immobilized on the surface of the substrates for detecting one or more analytes by way of an affinity assay method (with binding of the binding partner from a supplied solution to the immobilized binding partner).

These specific binding partners can be applied to an adhesion-promoting layer applied with the aid of the coating method of the invention or else directly to the uncoated surface of the substrates, wherein, preferably in a subsequent coating step according to the method of the invention, remaining areas of the surface which are free from specific binding partners are provided with a passivation layer (see below).

In a broadly applicable embodiment of the method of the invention, the specific binding partners immobilized on the surface of said substrates are biological or biochemical or synthetic recognition elements for specifically recognizing one or more analytes present in a supplied sample.

In this context, different specific recognition elements of this kind are usually present in each case in a form as highly pure as possible in different discrete measurement areas, so that generally different analytes from the sample bind to measurement areas containing different recognition elements. Such arrays of measurement areas are also referred to as "capture areas".

Since the physicochemical properties (e.g. polarity) of different recognition elements differ more or less strongly, there are also corresponding differences in the conditions for optimal immobilization of said recognition elements, for example by adsorption or covalent binding, in discrete measurement areas on a shared solid support, where appropriate on an adhesion-promoting layer applied thereto. Consequently, the immobilization conditions (such as, for example, type of adhesion-promoting layer) chosen for immobilization of a multiplicity of different recognition elements, can hardly be optimal for all recognition elements at the same time but represent merely a compromise between the immobilization properties of the various recognition elements.

Another disadvantage of this kind of assay is the fact that detection of analytes in a multiplicity of different samples usually requires the provision of a corresponding number of discrete arrays of recognition elements to which the different samples are supplied, on shared or discrete supports. This means the need for a large number of discrete arrays whose preparation is relatively complicated, in order to study a multiplicity of different samples.

The international patent applications PCT/EP 03/09561 and PCT/EP 03/09562, whose contents are hereby incorporated in their entirety as part of the present invention, propose a novel assay design which enables a multiplicity of samples in an array on a shared support simultaneously for analytes present in said samples. For this purpose, the samples to be studied themselves, rather than the different specific recognition elements, are applied, either untreated or after very few preparative steps, to a substrate in discrete measurement areas in an array. The two application documents mentioned refer to such an assay design as "inverted assay architecture".

Another broadly applicable embodiment of the method of the invention is therefore characterized in that the specific binding partners immobilized on the surface of said substrates are the one or more analytes themselves, which are immobilized either by being embedded in a native sample matrix or in a form of the sample matrix, which has been modified by one or more processing steps.

Said binding partners, i.e. the self-immobilized analytes to be detected or the analytes to be detected in a supplied sample and/or their biological or biochemical or synthetic recognition elements which are immobilized or are supplied in a supplied detection reagent, may be selected from the group comprising proteins, for example mono- or polyclonal antibodies and antibody fragments, peptides, enzymes, glycopeptides, oligosaccharides, lectins, antigens for antibodies, proteins functionalized with additional binding sites ("tag proteins" such as, for example, "histidine-tag proteins") and nucleic acids (for example DNA, RNA, oligonucleotides) and nucleic acid analogs (e.g. PNA), aptamers, membrane-bound and isolated receptors and their ligands, cavities generated by chemical synthesis for receiving molecular imprints, natural and artificial polymers, etc.

In this context, said specific binding partners applied to the surface of the substrates may be immobilized in discrete measurement areas (spots) which have any geometry, for example a circular, oval, triangular, rectangular, polygonal shape etc., wherein an individual measurement area may contain identical or different specific binding partners.

Preference is given to discrete measurement areas being generated by spatially selective application of specific binding partners to said substrates, preferably by using one or more methods from the group of methods comprising "ink jet spotting", mechanical spotting, "microcontact printing", fluidic contacting of the areas for the measurement areas to be generated with the compounds to be immobilized by supplying the latter in parallel or crossed microchannels, with the action of pressure differences or electric or electromagnetic potentials, and also photochemical and photolithographic immobilization methods.

As already mentioned above, for the purpose of minimizing unspecific binding of analyte molecules or of their detection reagents in areas free from immobilized specific binding partners of the substrate surfaces, preference is given to compounds which are "chemically neutral" toward the analytes and/or toward its binding partners being applied between the spatially separated measurement areas or in unoccupied subsections within said measurement areas. Preferably, these compounds which are "chemically neutral" toward the analytes and/or toward its binding partners are selected, for example, from the groups comprising albumins, in particular bovine serum albumin or human serum albumin, casein, unspecific, polyclonal or monoclonal, heterologous antibodies or antibodies which are empirically unspecific for the analyte(s) to be detected and their binding partners (in particular for immunoassays), detergents—such as, for example, Tween 20—, fragmented natural or synthetic DNA which does not hybridize with polynucleotides to be analysed, such as, for example, extracts of herring or salmon sperm (in particular for polynucleotide hybridization assays), or else uncharged but hydrophilic polymers such as, for example, polyethylene glycols or dextrans.

The present invention therefore relates to a method of the invention according to any of the embodiments mentioned, which method is characterized in that the layer deposited on the substrates is a passivation layer, which is applied in between the spatially separated measurement areas or in unoccupied partial areas within said measurement areas, compounds which are "chemically neutral" toward the analytes and/or toward its binding partners, after said measurement areas have been generated, and which preferably comprises, for example, compounds from the groups comprising albumins, in particular bovine serum albumin or human serum albumin, casein, unspecific, polyclonal or monoclonal, heterologous antibodies or antibodies which are empirically unspecific for the analyte(s) to be detected and their binding partners (in particular for immunoassays), detergents—such as, for example, Tween 20—, fragmented natural or synthetic DNA which does not hybridize with polynucleotides to be analysed, such as, for example, extracts of herring or salmon sperm (in particular for polynucleotide hybridization assays), or else uncharged but hydrophilic polymers such as, for example, polyethylene glycols or dextrans.

The present invention also relates to a substrate for detecting one or more analytes by way of an affinity assay method, comprising an adhesion-promoting layer, characterized in that said adhesion-promoting layer is generated by a coating method of the invention according to any of the embodiments mentioned.

The present invention likewise relates to a substrate for detecting one or more analytes by way of an affinity assay method, comprising a passivation layer covering at least partial areas of the substrate, characterized in that said passivation layer is generated by a coating method of the invention according to any of the embodiments mentioned.

The present invention further relates to a substrate according to any of the embodiments mentioned for application in human and/or animal diagnostics.

The present invention is explained in more detail below by way of an exemplary embodiment.

EXAMPLES

1. Coating Apparatus and Coating Method of the Invention

FIG. 1 depicts a diagrammatic representation of a coating apparatus of the invention. The present example intends to "passivate", i.e. applying a "passivation layer", to the areas of substrates prepared for an affinity assay method, which are not covered by specific binding partners, using the apparatus of the invention. The apparatus of the invention comprises in this exemplary embodiment an desiccator (1) of approx. 21 in volume as a receptacle for the liquid to be atomized and of the mist volume to be generated above the liquid, a support (2) with the substrates (8) to be coated, an ultrasound atomizer ("Lucky Reptile Mini-Nebler", Reptilica, D-90431 Nuremberg, Germany) as actuator (3) for liquid atomization, a vaulted glass bowl as droplet precipitator (4) and a glass inlet (5) and an outlet (6) for gas and/or generated mist.

The ultrasound generator is immersed in the liquid to be atomized (7) during operation. In order to minimize the required liquid volume, the embodiment of the present example comprised embedding the ultrasound generator, fixed to the bottom of the desiccator, in a polydimethylsiloxane (PDMS) cast up to just below the sound-generating oscillating membrane there, so that only application of a thin layer of liquid to be atomized is required.

The very fine droplets generated by ultrasound action, which rise above the level of the liquid are additionally subjected to a turbulent flow with the aid of a weak nitrogen stream which is introduced via the inlet (5) into the receptacle, in order to generate a very homogeneous distribution of the resulting mist in the entire receptacle.

Planar optical thin-film waveguides as substrates, which are to be coated and which have the outer dimensions of 14 mm in width ×57 mm in length ×0.7 mm in thickness (for further details, see below), are stored horizontally (with respect to the liquid surface) in the support (2) at a distance of approx. 8 cm above the liquid surface during the coating process. In the present example, the support is designed as a support made of plastic and provided with holes, so that excess liquid deposited from the mist can discharge through these holes. In the present exemplary embodiment, the support can receive ten thin-film waveguides as substrates with the stated dimensions.

In the present example, the vaulted glass bowl as droplet precipitator is bonded to the underside of the support (2) and shields the substrates to be coated from splashes from the atomization solution (coating solution).

The very homogeneously distributed mist generated is deposited on the substrates having, in the present example, a high-refractive index wave-guiding layer (a) arranged on the top (with respect to storage in the coating apparatus), in the form of very small droplets, and a thin, continuous liquid film is formed on the top of these substrates even within 5 to 10 minutes. After a total incubation time of 30 minutes, the substrates are removed from the coating apparatus, carefully rinsed with running water of the highest purity (Millipore) and subsequently dried in a nitrogen stream.

In the present example, a volume of approx. 2 ml of passivating solution (of liquid to be atomized) is required for a thin-film waveguide of the stated dimensions as substrate.

2. Carrying Out Conventional Coating Methods 2.1. Substrates

Substrates used for an affinity assay method to be conducted therewith later are in the present examples (as also mentioned already under 1.) planar optical thin-film waveguides, in each case with the outer dimensions of 14 mm in width ×57 mm in length ×0.7 mm in thickness. Said substrates comprise in each case a glass substrate (AF 45) and a thin (150 nm), high-refractive-index layer of tantalum pentoxide applied thereto. In the glass substrate, two surface relief gratings (grating period: 318 nm, grating depth: (12+/−2) nm) are modulated longitudinally at a distance of 9 mm, which are intended to serve as diffractive gratings to couple light into the high-refractive-index layer.

A monolayer of mono-dodecylphosphate (DDP), formed by spontaneous self assembly, is applied as adhesion-promoting layer to the surface of the metal oxide layer of said substrates. The substrate surface provided with said adhesion-promoting layer is distinguished by high hydrophobicity. In each case 6 identical microarrays of in each case 144 discrete measurement areas (spots) which for their part are arranged in each case in 16 rows and 9 columns are applied to the substrates provided with the hydrophobic adhesion-promoting layer by using an ink jet spotter (model NP 1.2, GeSiM, Grosserkmannsdorf, Germany). Each spot is generated by applying a single droplet of approx. 350 pL in volume to the chip surface.

2.2 Reagents and Generation of Arrays of Measurement Areas on the Substrates

The present example intends to immobilize the analytes to be detected themselves on the prepared substrates in a subsequent affinity assay method, which analytes are embedded in a native sample matrix or in a sample matrix form which has been prepared by a few sample preparation steps (cell lysate). These forms of the samples are referred to also as "nature-identical samples" herein below. The detection step is then intended to be carried out after supplying further detection reagents.

Detection of biologically relevant protein analytes in the "nature-identical" samples utilizes a human colon cancer cell line (HT29). These adherent cells are cultured in modified McCoy's 5A medium in conventional cell culture flasks made of plastic (Greiner Bio-One, St Gallen, Switzerland, Catalyst. No. 658170) at 37° C. Cell cultures of the same kind of various cell culture flasks are then irradiated with UV light for 10 minutes or treated with 10 μM doxorubicin. An otherwise identical cell culture that remains untreated and serves as a negative control in the analytical detection method is utilized as a comparative sample of said treated cell cultures.

After treatment, the different cell cultures are washed in each case with 10 ml of PBS (phosphate-buffered saline, cooled to 4° C.).

The cells are then detached from the bottom of the cell culture flasks and completely lysed at the same time by adding lysis buffer containing 7M urea, 2M thiourea and Complete (protease inhibitor, Roche AG, 1 tablet/50 ml), with all proteinaceous cell components being spontaneously denatured and solubilized. The cell lysate obtained in this way is centrifuged at 13 000×g in a bench centrifuge (Eppendorf, Hamburg, Germany) for 5 minutes in order to remove insoluble cell components (e.g. DNA and cell membrane fragments). The supernatant is removed and used for the following measurements, with a total protein concentration of typically between 5 mg/ml and 10 mg/ml.

The described treatments of the HT29 cell cultures result in damage to the DNA, that is, in the case of UV irradiation, inter alia due to chain breakage and the formation of thymine dimers, and, in the case of doxorubicin addition, due to its intercolation between neighboring bases of the DNA. As a result particular signal pathways inside damaged cells are activated or deactivated, which may cause, for example, programmed cell death (apoptosis). Responsible for activating or deactivating signal pathways are particular key proteins ("marker proteins") which regulate one or more signal pathways at one or more different sites by way of phosphorylation.

An example of regulating a signal pathway via a marker protein is the tumor suppressor protein p53 which, via its degree of phosphorylation, directs cell division, apoptosis and certain mechanisms for repairing damaged DNA. In cancer cells, regulation of said signal pathways is often disrupted at a particular or at several sites due to mutations or the absence of one or more marker proteins, and this may ultimately be responsible for uncontrolled growth.

The relative contents of p53 and P-p53 (phosphorylated form of p53) were detected and determined with the aid of highly specific antibodies which bind to these proteins which are to be immobilized as analytes in the cell lysates, which have been obtained and treated further, directly on the substrates (preferably after applying an adhesion-promoting layer as described above).

The cell lysates obtained are diluted by a factor of 10-20 to a total protein concentration of about 0.4 mg/ml and subsequently applied in discrete measurement areas for generating an array of measurement areas on the metal oxide surface of the thin-film waveguides as substrates, which has been provided with the adhesion-promoting layer. In addition to the measurement areas containing cell lysates applied thereto, each microarray comprises further measurement areas containing Cy5 fluorescently labeled bovine serum albumin (Cy5-BSA) immobilized therein, which are used as references of local differences and/or variations with time of the excitation light intensity during the measurement ("reference spots"). Cy5-BSA is applied in a concentration of 0.5 nM in 7M urea, 2M thiourea (labeling rate: approx. 3 Cy5 molecules per BSA molecule).

Figure 2:
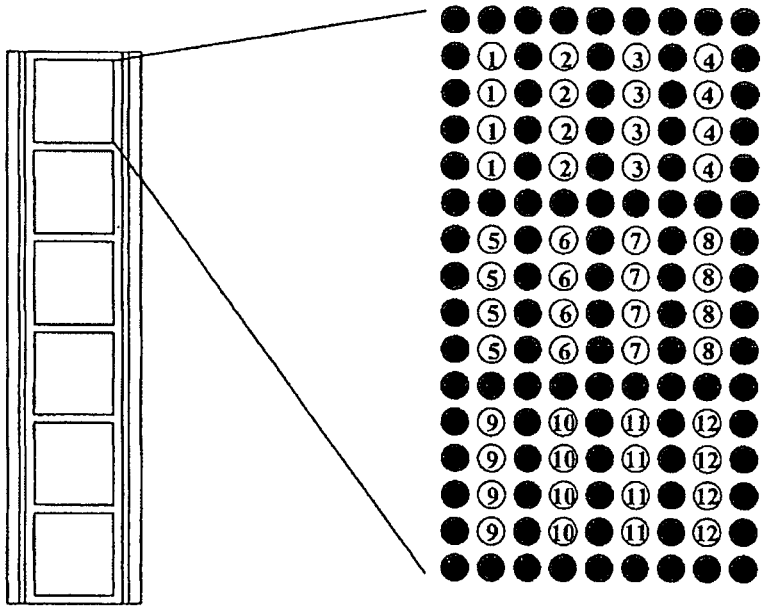
FIG. 2 depicts the geometry of an arrangement of measurement areas with 12 different applied samples in a two-dimensional array ("microarray") and a linear arrangement of 6 arrays on a shared substrate.

FIG. 2 depicts the geometry of the arrangement of the measurement areas in a two-dimensional array and a linear arrangement of six (identical) arrays on a substrate. The spots are spaced (center to center) at 300 μm and have a diameter of about 120 μm. An array of measurement areas for these examples in each case comprises an arrangement of measurement areas containing 12 different samples applied in 4 replicas, with the 4 identical measurement areas being arranged in each case in a shared column perpendicular to the direction of propagation of the light guided within the wave-guiding layer of these substrates during the detection step. The in each case 4 identical measurement areas are intended to aid the determination of the reproducibility of the measurement signals within the arrays of measurement areas. Columns of measurement areas containing Cy5-BSA applied thereto (for reference purposes) are in each case arranged between and next to the columns of measurement areas containing samples to be analysed applied thereto. The analytical platform of the invention in this example comprises 6 identical arrays of this kind of measurement areas as depicted in FIG. 2.

2.3 Passivation of the Free Regions Between and within the Measurement Areas

After the "nature-identical" samples and Cy5-BSA have been applied, the substrates are dried in a dust-free atmosphere, before saturating (passivating) in a further step the free, uncovered hydrophobic surface areas of the substrates with bovine serum albumin (BSA) to minimize undesired unspecific binding of detection reagents, in this case antibodies and/or fluorescently labeled molecules.

The surface passivation method of the invention which has been described under 1. above is compared to two other methods (2.3.1. dipping method and 2.3.2. spraying method), using freshly filtered passivation solution (50 mM imidazole, 100 mM NaCl, 3% BSA (w/v) pH 7.4) in all cases. After the free surface has been passivated by the methods described under 1. and below, respectively, the substrates are kept at 4° C. in sealed polystyrene tubes until measurement as part of the affinity assay method to be carried out subsequently.

2.3.1. Dipping Method

The planar optical thin-film waveguides as substrates are dropped vertically into a vessel (polystyrene tubes) filled with passivating solution, in order to wet the entire surface of said substrates simultaneously, if possible, and rapidly. After incubation at room temperature for one hour, the substrates are carefully rinsed under running water of the highest purity (Millipore) and then dried in a nitrogen stream (grade 50). Each thin-film waveguide of the stated dimensions as substrate requires a volume of approx. 25 ml of passivating solution.

2.3.2. Spraying Method

The passivating solution is sprayed here onto the substrates by means of a chromatography atomizer (Glas Keller Cat. No. 12.159.603, Basel, Switzerland) and a pressure of approx. 3.5 bar, until a continuous liquid film has formed on their surface to be coated. The distance between the outlet nozzle of the atomizer and the substrate surface here is approx. 30 cm. The substrates treated in this way are then incubated in a sealed container at room temperature and 100% humidity for one hour, then carefully rinsed under running water of the highest purity (Millipore) and finally dried in a nitrogen stream (grade 50). Each substrate of the embodiment stated in these examples requires a volume of approx. 3 ml of passivating solution.

3. Affinity Assay Method 3.1. Assay Design

Detection of particular proteins in general (i.e., for example, with or without phosphorylation) or of particular proteins especially in activated (e.g. phosphorylated) form in the immobilized cell lysates applied in discrete measurement areas is carried out by sequentially adding corresponding detection reagents prior to measuring the resulting fluorescent signals: in preparation for a first assay step, polyclonal analyte-specific rabbit antibodies (antibody A1 (#9282): anti-p53; antibody A2 (#9284): anti-Phospho-p53 (Ser15); both antibodies obtained from Cell Signaling Technology, INC., Beverly, Mass., USA) are diluted in a ratio of 1:500 in assay buffer (50 mM imidazole, 100 mM NaCl, 5% BSA, 0.1% Tween 20 pH 7.4). In each case 30 μl of these different antibody solutions are applied in each case to one of said 6 identical arrays of measurement areas, followed by incubation at room temperature overnight (first assay step). Excess, non-specifically bound antibodies are removed by washing each array with assay buffer (2×200 μl).

For detection of bound analyte-specific antibodies in discrete measement areas, contained there in the immobilized cell lysates, a second assay step is carried out using an Alexa Fluor 647-labeled anti-rabbit Fab fragment (Molecular Probes, Cat. No. Z-25308, Leiden, The Netherlands) which binds to the abovementioned antibodies A1 and A2. This fluorescently labeled Fab fragment is applied in a dilution of 1:500 in assay buffer, starting from the commercially available stock solution, to the arrays (30 μl each) and then incubated at room temperature in the dark for one hour. The arrays are then washed with assay buffer (in each case twice with 200 μl) in order to remove non-specifically bound fluorescently labeled Fab fragments. The analytic platforms prepared in this way are then stored until the detection step by means of excitation and detection of resulting fluorescence signals in a ZeptoREADER™ (see below).

3.2. Determination of the Fluorescence Signals from the Arrays of Measurement Areas The fluorescence signals from the various arrays of measurement areas are measured sequentially and automatically using a ZeptoREADER™ (Zeptosens AG, CH-4108 Witterswil, Switzerland). For each array of measurement areas the planar optical thin-film waveguide as substrate (according to 2.1.) is adjusted to meet the resonance condition for coupling light via a grating structure (c) into the wave-guiding tantalum pentoxide layer and to maximize the excitation light available in said measurement areas. Subsequently, each array generates a number, which can be chosen by the user, of images of the fluorescence signals from the array in question, it being possible to choose different exposure times. The excitation wavelength in the measurements for the present example is 635 nm, and the fluorescence light is detected at the fluorescence wavelength of Cy5 using a cooled camera and an interference filter (transmission (675±20) nm) for suppressing scattered light at the excitation wavelength, which filter is positioned in front of the camera lens. The fluorescence images generated are stored automatically on the storage disk of the control computer. Further details of the optical system (ZeptoREADER™) are described in the International Patent Application PCT/EP 01/10012 which is hereby incorporated in its entirety as part of the present application.

3.3. Evaluation and Referencing

The average signal intensity from the measurement areas (spots) is determined with the aid of an image analysis software (ZeptoVIEW™, Zeptosens AG, CH-4108 Witterswil), which enables the fluorescence images of a multiplicity of arrays of measurement areas to be evaluated semiautomatically.

The raw data of the individual pixels of the camera constitute a two-dimensional matrix of digitalized measured values, with the measured intensity as measured value of an individual pixel corresponding to the area on the sensor platform projected thereto. The data are evaluated by firstly laying manually a two-dimensional (coordinate) grid over the pixel values in such a way that the partial image of each spot falls within an individual two-dimensional grid element. Within this grid element, each spot is assigned a circular "evaluation area" (area of interest, AOI) which should be well ajustable and which has a radius to be defined by the user (typically 120 μm). The image analysis software determines the location of the individual AOIs individually as a function of the signal intensity of the individual pixels, with the radius of said AOIs, defined by the user at the start, being preserved. The average total signal intensity of each spot is determined by way of the arithmetic mean of the pixel values (signal intensities) within a chosen evaluation area.

The background signals are determined from the measured signal intensities between the spots. For this purpose, four further circular areas (which typically have a combined radius identical to that of the evaluation areas of the spots) per spot are defined as evaluation areas for background signal determination, which are preferably arranged in the middle between neighboring spots. The average background signal intensity of these four circular areas is determined, for example, as the arithmetic mean of the pixel values (signal intensities) within an AOI chosen for this. The average net signal intensity from the measurement areas (spots) is then calculated as the difference between the local average total signal intensity and the local average background signal intensity of the particular spot.

Referencing of the net signal intensity of all spots is carried out in each case with the aid of reference spots (Cy5-BSA) of each array of measurement areas. For this purpose, the net signal intensity of each spot is divided by the average of net signal intensities of the neighboring reference spots of the same row (arranged parallel to the direction of propagation of the light guided within the evanescent field sensor platform). Said referencing offsets the local differences of the available excitation light intensity orthogonally to the direction of light propagation both within each microarray and between different microarrays.

3.4. Results

Figure 3:
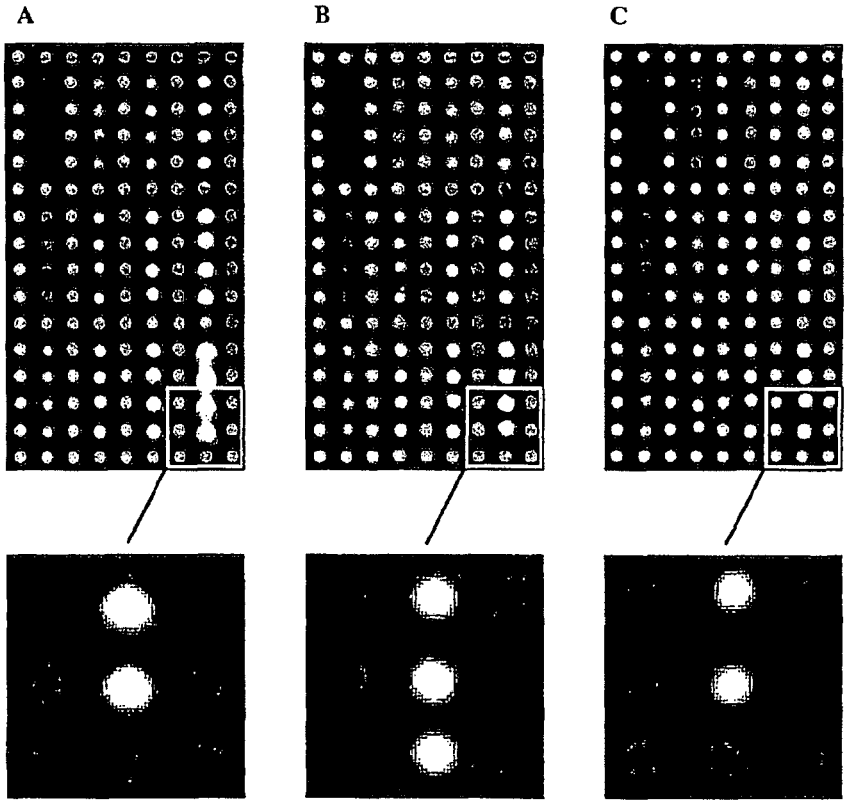
FIG. 3A-FIG. 3C depict the fluorescence signals of microarrays, wherein the free surfaces of the corresponding substrates were passivated with the aid of different coating methods, in each case with magnifications (below) of the image details indicated (A: dipping method, B: spraying method, C: atomization method of the invention).

FIG. 3A depicts a typical image of the fluorescence signals of a microarray after an assay for detecting p53, wherein free areas between the measurement areas were passivated with the aid of the dipping method (according to 2.3.1.). The signal intensity within each individual reference spot and between different reference spots (Cy5-BSA) is distributed very uniformly and homogeneously, and the edges of the nearly ideally circular spots stand out sharply against the background (see image detail). In contrast, the measurement areas of the immobilized cell lysates are characterized by trail-like "smudges" which can be seen particularly clearly with high signal intensities. These "smudges" are, as described above, caused at the moment of immersion of the substrates provided with the spots into the passivating solution, by parts of the sample which have not been tightly adsorbed and have been detached from the measurement areas by said passivating solution and which are adsorbed along the flow in the opposite direction of immersion in the immediate proximity of such a measurement area to the free not yet passivated substrate surface, even before the latter can be passivated with the BSA contained in the passivating solution. Since these parts of the sample which have been detached from the measurement areas and readsorbed in the vicinity always also contain a certain amount of the analytes to be detected, a corresponding fluorescence signal becomes visible at said sites during read-out.

FIG. 3B depicts a typical image of the fluorescence signals of a microarray after an assay for detecting p53, wherein free areas between the spots were passivated by means of the spraying method (according to 2.3.2.). The signals from the reference spots are comparable with those of a microarray after using the dipping method, both with regard to their form and uniformity or homogeneity and their intensity. The signals from the measurement areas containing immobilized cell lysates are, with regard to their intensity, likewise comparable with the corresponding measured signals from the microarrays which had been subjected to the dipping method. Owing to the fact that flows of passivating solution on the substrate surface can be neglected in the spraying method, contrary to the dipping method, the cell lysate spots do not exhibit the above-described "smudges", however, but merely smaller "outgrowths" with lower fluorescence intensity, which are evidently arranged approximately randomly around the spots provided. Said outgrowths are very likely caused by local detachment and flowing out of cell lysate which is not tightly bound to the edges of the measurement areas, since the small spray droplets of the passivating solution landing here have a non-negligible momentum perpendicular to the coated surface, when hitting said surface, and this can generate splashes.

FIG. 3C depicts a typical image of the fluorescence signals of a microarray after an assay for detecing p53, wherein free areas between the measurement areas were passivated by means of the method of the invention by atomizing passivating solution, as described under 1. The high quality, with comparably good homogeneity and shape, of reference spots and cell lysate spots, in comparison with the microarrays passivated by the other methods described, is noticeable here. "Smudges" or "outgrowths" of the cell lysate spots can be avoided here owing to the essentially undirected and momentum-free, apart from gravitational influences, application of the passivating solution in the form of very fine mist droplets whose size is distinctly below that of droplets produced by spraying.

The efficiency of passivating the surface which is free from components from the immobilized sample, i.e. the extent of suppressing unspecific binding by means of the BSA contained in the passivating solution, can be determined semi-quantitatively from the signal intensity measured in the spot-free areas (between the spots, "background signals"). Accordingly, a surface incompletely covered with BSA would give a higher signal than a surface coated with BSA throughout, owing to at least partially occurring unspecific binding of the fluorescently labeled detection reagents (Alexa 647 anti-rabbit Fab) used in the assay to the BSA-free surface.

Figure 4A:
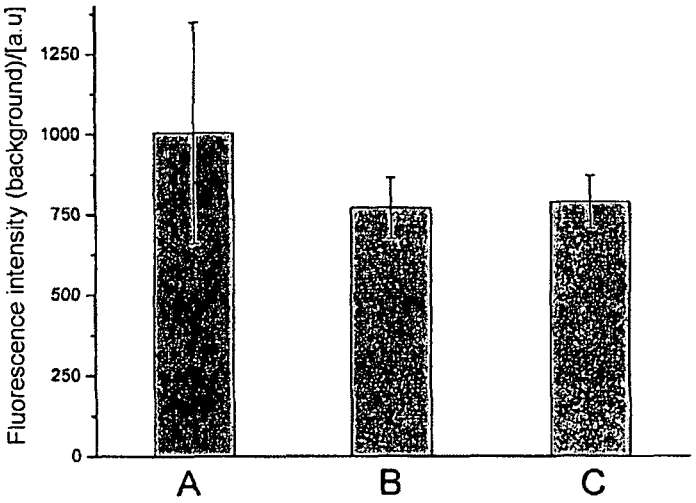
FIG. 4A depicts the averages and standard deviations of the background signal intensities which were determined in each case between all spots of the microarrays, wherein the free surfaces of the corresponding substrates were passivated with the aid of different coating methods (A: dipping method, B: spraying method, C: atomization method of the invention).

FIG. 4A depicts the averages and standard deviations of the background signal intensities which were determined between all spots of the free substrate surfaces containing the microarrays generated thereupon, which surfaces had been passivated with the aid of the three different methods. The letters A, B and C refer, as they do in FIG. 4B, FIG. 5A and FIG. 5B, to passivation by means of the dipping method (A), spraying method (B) and, respectively, methods by way of atomizing the passivation solution (C). On the basis of the measured (lower) background signal intensities, the passivation efficiency is surprisingly shown to be distinctly higher after treatment with the spraying method and the atomization method of the invention than after applying the dipping method for surface passivation. Moreover, the standard deviation of the background signal intensities is, at 11-12%, in each case distinctly smaller after applying the spraying method or the atomization method of the invention than after using the dipping method for surface passivation, the latter resulting in a standard deviation of background signal intensities of 34%. This leads to the conclusion that the uniformity or homogeneity of the coating is also higher after applying the spray method or the atomization method than after using the dipping method.

Figure 4B:
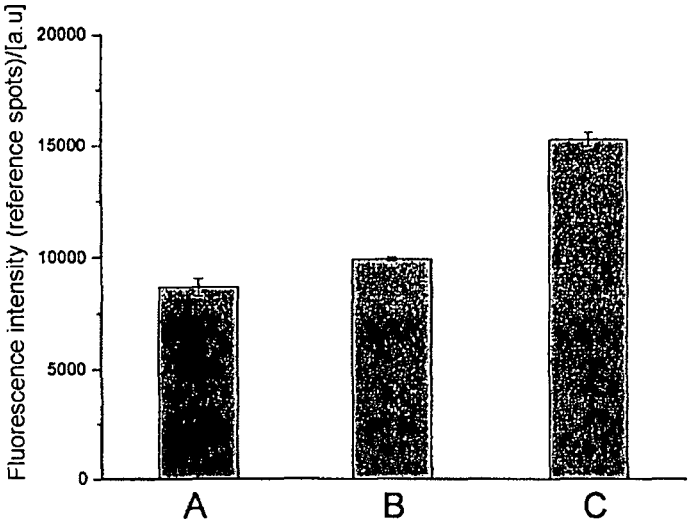
FIG. 4B depicts the averages and standard deviations of the fluorescence intensities of all reference spots (for terminology see exemplary embodiment) of the microarrays, wherein the free surfaces of the corresponding substrates were passivated with the aid of different coating methods (A: dipping method, B: spraying method, C: atomization method of the invention).

FIG. 4B depicts the averages of fluorescence intensities of all reference spots of the microarrays, wherein the free surfaces of the corresponding substrates were again treated with the three different coating methods. The comparison surprisingly demonstrates that the signal intensity is increased slightly after applying the spraying method and markedly (that is by about 60%) after applying the atomization method, compared with the signals after applying the dipping method. These differences are attributed to the reduction in volume of passivating solution applied, which is likely to be able to partially detach Cy5-BSA compounds applied for referencing, and to the virtually momentum-free application of passivating solution in the case of the atomization method.

Figure 5A:
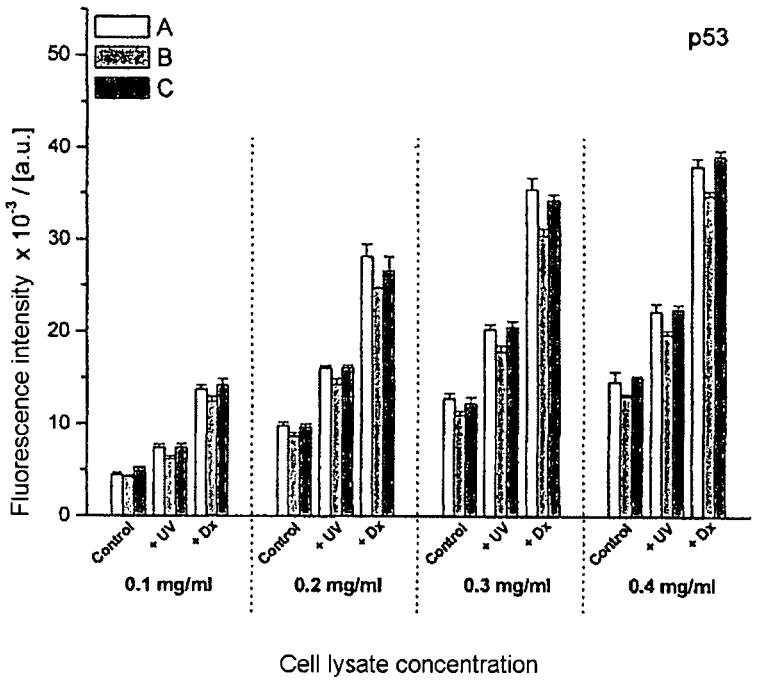
FIG. 5A depicts the averaged intensities and standard deviations of the fluorescence signals from the measurement areas of the microarrays, which are designed for analyte detection, wherein the free surfaces of the corresponding substrates were passivated with the aid of different coating methods (A: dipping method, B: spraying method, C: atomization method of the invention) and the microarrays were subsequently incubated with solutions of the antibody A1 (anti-p53) and then in each case for detection by means of fluorescence detection with Alexa 647 Fluor anti-rabbit Fab fragments.

FIG. 5A depicts the averaged intensities and standard deviations of the fluorescence signals from the measurement areas, designated for analyte detection, of the microarrays whose substrate surfaces were treated in each case with the different passivating methods and which were then incubated with solutions of the antibody A1 (anti-p53) (FIG. 5A, top) and A2 (anti-Phospho-p53) (FIG. 5A, bottom) and then, in each case for detection by means of fluorescence detection, with Alexa 647 Fluor anti-rabbit $F_{ab}$ fragments. The measured fluorescence signal intensities correlate with the relative analyte content in each cell lysate (corresponding to the cell lysate concentration; a higher signal corresponding to a higher analyte concentration, with said correlation obviously not being linear).

In comparison with the control sample without pretreatment (in each case indicated as "control" in FIG. 5A and FIG. 5B), the lysate of the HT29 cell culture treated with UV light (in each case indicated by "+UV" in FIG. 5A and FIG. 5B) and in particular that of the HT29 cell culture treated with doxorubicin (in each case indicated by "+Dx" in FIG. 5A and FIG. 5B) exhibit a markedly increased p53 content caused by an increase in expression of this protein in the relevant cells.

Figure 5B:
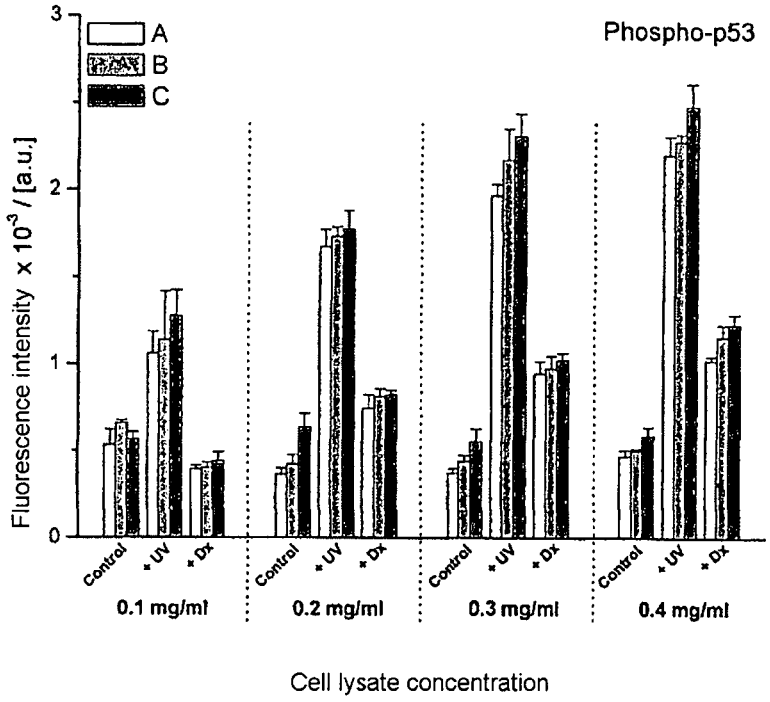
FIG. 5B depicts the averaged intensities and standard deviations of the fluorescence signals from the measurement areas of the microarrays, which are designed for analyte detection, wherein the free surfaces of the corresponding substrates were passivated with the aid of different coating methods (A: dipping method, B: spraying method, C: atomization method of the invention) and the microarrays were subsequently incubated with solutions of the antibody A2 (anti-phospho-p53) and then in each case for detection by means of fluorescence detection with Alexa 647 Fluor anti-rabbit Fab fragments.

In contrast, FIG. 5B indicates that the Phospho-p53 content in the UV light-treated sample is likewise markedly increased in comparison with the control sample, while the Phospho-p53 content in the doxorubicin-treated sample is only slightly above (in the case of lysate concentrations from 0.2 mg/ml to 0.4 mg/ml) or even below (in the case of the lysate concentration of 0.1 mg/ml) that of the control sample. This indicates that the signal pathway induced by DNA damage, in which Phospho-p53 acts as a key regulatory protein, responds clearly to the treatment with UV light but evidently only weakly to the treatment with doxorubicin in this cell line.

It is essential, with regard to the influence of the different methods used for passivating the free substrate surfaces, that the measured signal intensities from the measurement areas for analyte detection are not significantly different statistically, taking into account variations due to the experiments (error bars), i.e. they are independent of the coating method carried out for surface passivation. This means that—evidently in contrast to the effects on the Cy5-BSA compounds used for referencing—the different passivation methods do not differ with regard to the influence on the cell lysates adsorbed to the substrates.

In summary, these results demonstrate that the method of the invention for applying the passivating solution to the substrate surface by means of atomization offers distinct advantages, in contrast to the conventional dipping method and even to the spraying method, and fully meets the requirements made. It is obvious to the skilled worker that the method for substrate coating for surface passivation, illustrated in the exemplary embodiments above, is directly applicable to coatings with suitable adhesion-promoting layers and can be generalized in this manner.

The invention claimed is:

1. An apparatus for coating substrates capable of detecting one or more analytes in an affinity assay on a support, comprising:

a liquid receptacle comprising a liquid receiving portion configured to receive a liquid to be atomized and a mist volume receiving portion configured to receive a mist volume generated from the liquid to be atomized, an actuator for inducing atomization of the liquid to be atomized in the liquid receiving portion, a support capable of receiving and storing the substrates in the mist volume receiving portion and not in contact with a surface of the liquid to be atomized, and a droplet precipitator positioned between the surface of the liquid to be atomized and the support, wherein the support is configured to expose at least a surface of the substrate facing away from the surface of the liquid to be atomized to the mist volume generated from the liquid to be atomized, and wherein at least a part of the mist volume receiving portion is above the surface of the liquid to be atomized and the surface of the substrate facing away from the surface of the liquid to be atomized.

2. The apparatus as claimed in claim 1, wherein said actuator is capable of generating ultrasound.

3. The apparatus as claimed in claim 1, wherein said actuator comprises a membrane of an ultrasound generator.

4. The apparatus as claimed in claim 1, wherein said actuator is immersed in the liquid to be atomized during operation.

5. The apparatus as claimed in claim 1, wherein the droplet precipitator is impermeable to vapor and mist.

6. The apparatus as claimed in claim 1, wherein the droplet precipitator is permeable to droplets up to a defined size.

7. The apparatus as claimed in claim 5, wherein the droplet precipitator has a shape of a concave mirror.

8. The apparatus as claimed in claim 6, wherein the droplet precipitator comprises a fine-mesh netting having a mesh size which determines the maximum size of droplets that can pass through the fine-mesh netting.

9. The apparatus as claimed in claim 1, further comprising at least one gas inlet.

10. The apparatus as claimed in claim 1, further comprising a means for generating a uniform distribution of the mist generated from the liquid to be atomized.

11. The apparatus as claimed in claim 10, wherein said means for generating a uniform distribution of the mist generated from the liquid to be atomized comprises a ventilator.

12. The apparatus as claimed in claim 1, further comprising a means for controlling and/or regulating the temperature of the liquid to be atomized and/or a one or all walls of the liquid receptacle.

13. The apparatus as claimed in claim 1, wherein the support optionally comprises a thermostat.

14. The apparatus as claimed in claim 1, further comprising a means for controlling and/or regulating a pressure inside the liquid receptacle.

15. The apparatus as claimed in claim 1, further comprising a means for rotating the substrates on an axis perpendicular to a plane of the support.

16. The apparatus as claimed in claim 1, further comprising a means for collecting and recycling/recovering atomized liquid deposited on a wall of the liquid receptacle.

17. The apparatus as claimed in claim 1, further comprising a means for facilitating cleaning of the liquid receptacle.

18. The apparatus as claimed in claim 1, further comprising a means for controlled adjustment and/or variation of a distance between the surface of the liquid to be atomized and a surface of the substrates.

19. The apparatus as claimed in claim 1, wherein the substrates are stored essentially horizontally in the support.

20. The apparatus as claimed in claim 1, wherein the liquid receptacle is closed, except for one or more optional inlets for gas and, optionally, one or more outlets for gas and/or mist.

21. The apparatus as claimed in claim 1, wherein the liquid to be atomized has a viscosity of less than 3 cP.

22. The apparatus as claimed in claim 1, wherein the liquid to be atomized is an aqueous solution.

23. The apparatus as claimed in claim 1, wherein the liquid to be atomized is an organic solution.

24. The apparatus as claimed in claim 23, wherein the liquid to be atomized is an alcoholic solution.

25. The apparatus as claimed in claim 1, wherein the substrates are essentially planar.

26. The apparatus as claimed in claim 1, wherein the substrates consist of one or more layers.

* * * * *